United States Patent [19]

Becker

[11] 4,241,527

[45] Dec. 30, 1980

[54] DISPLAY CURTAIN

[76] Inventor: James L. Becker, 3005 Waterford Dr., Cinnaminson, N.J. 08077

[21] Appl. No.: 878,241

[22] Filed: Feb. 16, 1978

[51] Int. Cl.[3] ..... G09F 1/10

[52] U.S. Cl. ..... 40/124.2

[58] Field of Search ..... 40/10, 152.1, 124, 124.2, 40/124.4; 160/178 R, 231 R

[56] References Cited

U.S. PATENT DOCUMENTS

| | | | |
|---|---|---|---|
| 138,454 | 4/1873 | Van Eps | 40/124 |
| 1,238,988 | 9/1917 | Connor | 40/124 |
| 1,810,899 | 6/1931 | Boehm | 160/231 R |
| 2,209,972 | 8/1940 | Horwitt | 40/152.1 |
| 2,724,434 | 11/1955 | Smith | 160/231 R |
| 2,749,072 | 6/1956 | Long | 160/178 R |
| 3,531,879 | 10/1970 | Bogese | 40/124.4 |
| 3,816,948 | 6/1974 | Mooney et al. | 40/124.2 |

*Primary Examiner*—Gene Mancene
*Assistant Examiner*—Wenceslao J. Contreras
*Attorney, Agent, or Firm*—Duffield & Lehrer

[57] ABSTRACT

A plurality of horizontally extending rod shaped elements are secured together so as to lie in a substantially vertical plane with a relatively small space remaining between adjacent elements. A variety of clips may be affixed to the curtain for supporting and displaying various different items. The clips include an upwardly extending tang which lies behind the curtain, a ledge which rests on one of the rod elements and a holding portion.

5 Claims, 14 Drawing Figures

DISPLAY CURTAIN

BACKGROUND AND SUMMARY

The present invention is directed toward a display curtain and more particularly toward a display curtain which can be easily assembled and disassembled and from which a wide variety of various items can be displayed.

Wall and various other types of hanging displays are a common merchandising technique and are used to display and sell numerous types of products. Heretofore, however, it has been necessary to secure the items desired to be displayed directly to the wall or other partitions using various different fastening devices. This not only was time consuming but often caused damage to the walls.

Outside the commercial marketing field, wall displays are used by numerous people such as collectors. For example, record collectors often desire to display the album covers of their collection. Other items such as beer cans are also being collected by more and more people who also desire to display their collections. Heretofore, there has not been any convenient way for such collectors to easily and inexpensively display their collections.

The present invention is useful for displaying a wide variety of different items for both commercial marketing and for the individual collector. It is comprised of a curtain which can be attached to a wall or other support from the top of the curtain and which extends downwardly therefrom. The curtain is constructed of a plurality of horizontally extending rod shaped elements which are secured together, side by side, so as to lie in a substantially flat plane. A relatively small space remains between adjacent elements so that the curtain is somewhat flexible. In this way, the curtain can be rolled or folded in the lengthwise direction. A variety of clips may be affixed to the curtain for supporting and displaying various different items. The clips include an upwardly extending tang which is adapted to lie behind the curtain, a ledge which is adapted to rest on one of the rod shaped elements and a holding portion which is adapted to hold the item being displayed. The clips are easily applied to or removed from the curtain so that various different arrangements can be made and various different items can be displayed on the same curtain.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
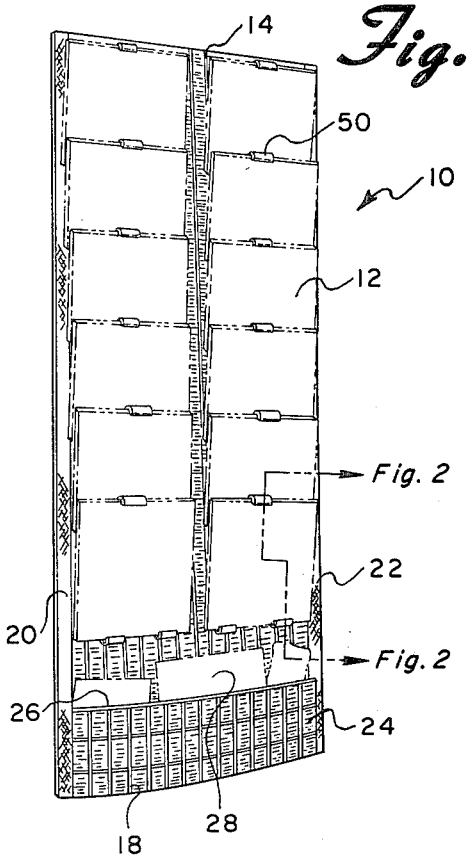
FIG. 1 is a front perspective view of a display curtain constructed in accordance with the principles of the present invention.

Referring now to the drawings in detail wherein like numerals have been used throughout the various figures to designate similar elements, there is shown in FIG. 1 a display curtain constructed in accordance with the principles of the present invention and designated generally at 10. The curtain 10 is shown suspended vertically on a wall or the like and in use displaying a plurality of record albums or the like 12.

The display curtain of the present invention is comprised essentially of two main parts. The curtain itself and various clips which may be temporarily affixed to the curtain for supporting and displaying various different items. The curtain 14 shown in FIG. 1 is comprised essentially of a plurality of horizontally extending rod shaped elements 18 (See FIGS. 2 and 3). The rods 16 are preferably circular in cross-section as shown in the figures but they also may have various other shapes. They may also be comprised of substantially any material. In a preferred embodiment, and by way of example only, the rods 16 are bamboo rods having a diameter of approximately 3/16 inches.

The plurality of rod shaped elements 16 which make up the curtain 14 are held together by string 18 or the like which is woven between the rods 16 at several spaced locations across the width of the curtain 14 (i.e. the length of the rods 16). The string is woven so that a space 19 remains between each adjacent pair of rods 16. The specific details of the curtain 14 are not shown since they are well known. Curtain 14 is essentially a bamboo curtain which has heretofore been known albeit not for the inventive purpose disclosed herein. The sides of the curtain 14 are preferably covered with a cloth tape or similar material such as shown at 20 and 22. In addition, the lower portion 24 of the curtain 14 is preferably folded upwardly so as to form a pocket 26 in the lower portion of the curtain 14. The pocket 26 may hold numerous different items such as magazines or the like 28.

Figure 2:
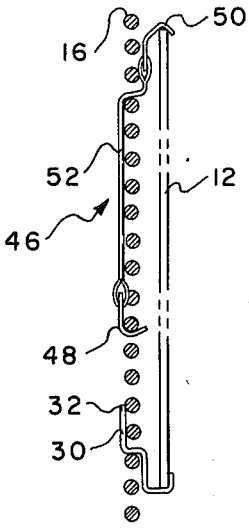
FIG. 2 is a cross-sectional view taken along the line 2—2 of FIG. 1.
Figure 3:
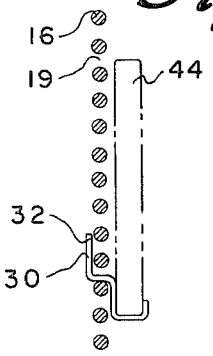
FIG. 3 is a view similar to FIG. 2 showing another use for the lower clip of FIG. 2.
Figure 4:
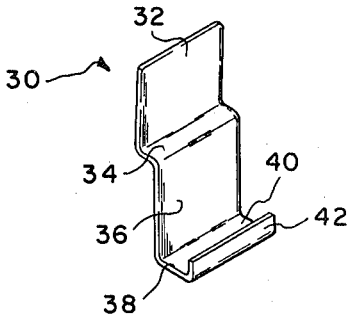
FIG. 4 is a perspective view of the lower clip shown in FIGS. 2 and 3.

The display curtain 10 is shown in FIG. 1 supporting a plurality of record albums 12 for display. Each album 12 is supported at the lower end thereof by a pair of clips 30, the details of which are shown in FIGS. 2–4. Each clip 30 includes an upwardly extending tang 32 which extends upwardly behind the curtain 14. Connected to the lower end of tang 32 is a substantially horizontally extending ledge 34 which lies in the space 19 between adjacent rods 16 and rests on the rod 16 immediately below the ledge 34. Extending downwardly from the front of the ledge 34 and substantially parallel to the tang 32 is a flange 36. The flange 36 terminates at the lower end thereof in a U-shaped portion 38 having a bottom wall 40 and a partial upwardly extending front wall 42.

The U-shaped portion 38 holds the bottom of the record album 12 as shown in FIG. 2. Preferably, the bottom wall 40 has sufficient depth to hold several albums 12 therein. The clip 30 may also be used to hold numerous items other than albums such as a tape cartridge or cassette 44 shown in FIG. 3. In this case, the U-shaped portion 38 of the clip 30 is made sufficiently large to accommodate the cartridge or cassette 44. Preferably, the clip 30 is fabricated from a single piece of sheet metal. It may, however, be made from numerous other materials such as plastic.

The clip 30 is affixed to the curtain 14 by first orienting the same so that the tang 32 is substantially horizontal. The upper end of the tang 32 is then passed through one of the openings 19 between adjacent rods 16. When the ledge 34 abuts the curtain 14, the clip 30 is pivoted into a vertical orientation so that the bottom of the ledge 34 rests on the rod 16 immediately therebelow. It has been found that clip 30 will not easily dislodge itself from the position shown in FIGS. 2 and 3 particularly when a downward force is applied to the U-shaped portion 38. It has also been found that an even more positive attachment can be obtained if the tang 32 is bent slightly forwardly so that the angle between the ledge 34 and the tang 32 is slightly less than 90 degrees.

Figure 5:
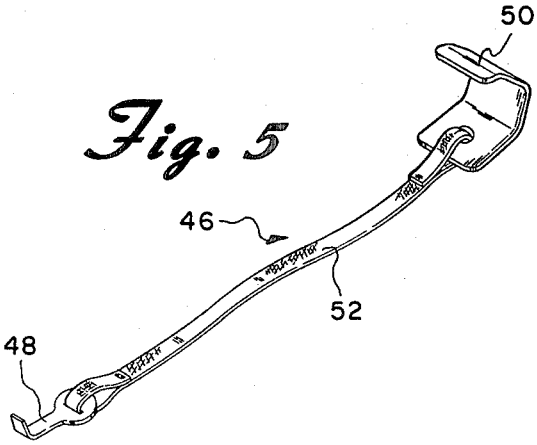
FIG. 5 is a perspective view of the upper clip shown in FIG. 2.

When the clip 30 is used to support a relatively tall article such as an album 12, it is also necessary to support the top of the article otherwise the same may fall forwardly. This may be accomplished by the use of an upper clip such as shown generally at 46 in FIGS. 2 and 5. Clip 46 is comprised of generally three main parts. A lower hook portion 38, an upper hook portion 50 and an elongated elastic element 52 connected there between.

The clip 46 is used by slipping the hook 48 through one of the openings 19 between adjacent rods 16 at a point below the top of the album 12. The elastic element 52 then runs behind the curtain 14 and the hook 48 is placed around one of the rods 16 such as shown in FIG. 2. The upper hook 50 is then placed over the top of the album 12. The rod to which the lower hook 48 is attached should be selected so that elastic element 52 is sufficiently taunt to maintain the album 12 in a substantially upright position. It is, of course, also possible to adjust the position of the lower hook 48 so that the album tilts slightly downwardly. This may be preferable for certain displays. As should be readily apparent from FIG. 2, an album is easily removed from the display curtain 10 merely by lifting the hook 50 from the top of the album and thereafter lifting the album from the U-shaped portion 38 of the clip 30. An album is placed on the display curtain 10 in exactly the opposite manner.

Figure 6:
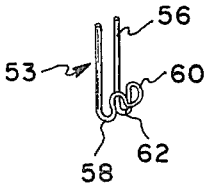
FIGS. 6–14 show several other clips which may be used as part of the present invention.
Figure 7:
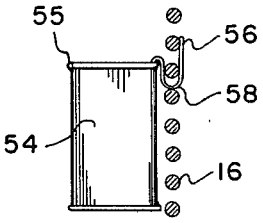

FIGS. 6–14 show various other types of clips which may be used with the present invention to hold other types of articles. In FIGS. 6 and 7, for example, there is shown a clip 53 which is particularly adapted to hold a beer or soda can 54 or the like for display. This clip is preferably made from a metallic wire material which is bent so as to have a pair of vertically extending tangs 56. The lower portions of the tangs 56 are bent to have a curved ledge 58 which is adapted to rest on a rod 16 directly therebelow. The wire of the clip then extends upwardly and then around and downwardly and toward the ledge 58 again so as to form a spring clip portion 60 having an opening 62 therebelow. A beer can 54 or the like is secured to the clip by forcing the rim 55 of the can up through the opening 62 so that the spring portion 60 grips the same. This is preferably done before the clip is attached to the curtain.

Figure 8:
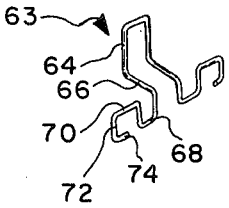
Figure 9:
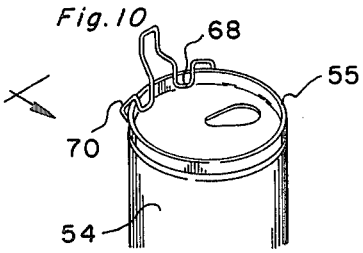
Figure 10:
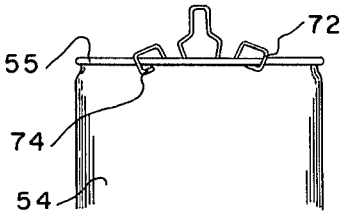

The clip 63 shown in FIGS. 8–10 is also particularly adapted to hold a beer can or the like but provides more positive locking. This clip 63 is also made from a metallic wire and also includes a pair of tangs 64 and ledges 66. The forward end of the ledges 66 are connected to horizontally extending fingers 68 which are in turn connected to struts 70, spur risers 72 and spurs 74. To attach clip 63 to a can 54, the clip is flexed so that the fingers 68 are against the rim 55 on the inside circumference of the can and the spur risers 72 are against the rim on the outside circumference of the can. In this position, the spurs 72 grab under the rim 55 to securely hold the can. This is shown most clearly in FIG. 10.

Figure 11:
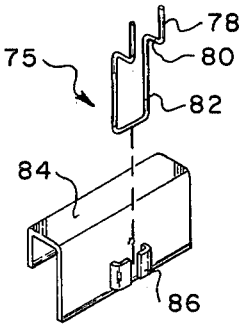
Figure 12:
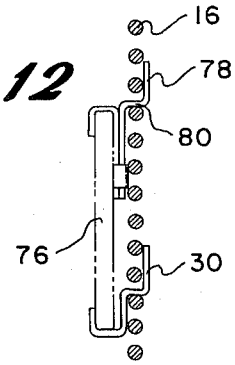

The clip 75 shown in FIGS. 11 ad 12 is used to hold items such as soft covered books 76 or the like which may be too flexible to be supported solely by a clip 30. As shown in FIG. 12, this clip is used in conjunction with a clip 30 and is used for the upper part of the book 76. The clip 75 is comprised of two parts. The first part includes a pair of tangs 78, a pair of ledges 80 and a downwardly extending guide 82. The other part of the clip includes an inverted U-shaped bracket 84 including a guideway 86 on the rear surface thereof which is adapted to be slid over the guide 82.

The clip 30 and the first portion of clip 75 including the guide 82 are positioned on the curtain 14 in the position shown in FIG. 12. Thereafter, guideway 86 of the bracket 84 is slid over the guide 82 and the entire bracket 84 is moved upwardly. Thereafter, a book or similar article is placed in the clip 30 and the bracket 84 is lowered so as to hold the top of the book 76.

Figure 13:
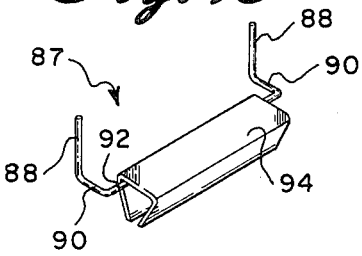

FIG. 13 shows a clip 87 which is particularly adapted for holding single sheets of paper, pamphlets or numerous other types of material. This clip also includes a pair of tangs 88 and ledges 90. A strut 92 connects the forward ends of the pair of ledges 90 and a spring clip 94 passes over the strut 92. The pamphlet or other material desired to be supported by clip 87 is held by the spring clip 94.

Figure 14:
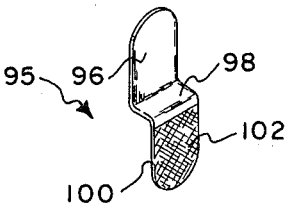

An even further embodiment of a clip which can be used with the present invention is shown in FIG. 14. This clip 95 is made from a flat stock material and also includes a tang 96 and a ledge 98. Extending downwardly from the ledge 98 so as to be parallel with the tang 96 is a flange 100. Affixed to the front surface of the flange 100 is an adhesive material 102. The article desired to be displayed on the curtain 14 is attached to clip 95 by pressing the same against the adhesive 102 after the clip 95 is attached to the curtain.

The present invention may be embodied in other specific forms without departing from the spirit or essential attributes thereof and accordingly, reference should be made to the appended claims, rather than to the foregoing specification an indicating the scope of the invention.

I claim:

1. A display device comprising:

a curtain, said curtain being comprised of a plurality of rod shaped elements connected together side by side such that said elements are adapted to lie substantially in the same plane and such that a small space remains between each adjacent pair of elements;

a plurality of clips adapted to be affixed to said curtain, each of said clips including a substantially straight tang having a thickness sufficiently small so that it can pass through one of said spaces, each of said clips further including a ledge adapted to rest on the rod shaped element immediately below said space and a flange portion, said flange portion carrying a holding means adapted to hold the item desired to be displayed by the display device, and a plurality of additional clip means, said additional clip means including first and second hook shaped members and an elongated elastic member connecting such first and second hook shaped members, each of said first hook shaped members being adapted to engage one of said rod elements.

2. A display device as claimed in claim 1 wherein at least some of said clips include a U-shaped holding means.

3. A display device as claimed in claim 1 wherein at least some of said clips are comprised of sheet metal.

4. A display device as claimed in claim 1 wherein at least some of said clips include a spring means as part of the holding means.

5. A display device as claimed in claim 1 wherein said curtain includes a pocket in the lower portion thereof.

* * * * *